US010821459B2

(12) United States Patent
Pruiett et al.

(10) Patent No.: US 10,821,459 B2
(45) **Date of Patent: *Nov. 3, 2020**

(54) APPARATUS FOR CLEANING A SURFACE

(71) Applicant: BISSELL Homecare, Inc., Grand Rapids, MI (US)

(72) Inventors: Jason W. Pruiett, Grand Rapids, MI (US); David M. Miller, Zeeland, MI (US); Joseph M. White, Grand Rapids, MI (US); Mitchell DeJonge, Fruitport, MI (US); Michael N. Supplee, Grand Rapids, MI (US)

(73) Assignee: BISSELL Inc., Grand Rapids, MI (US)

( * ) Notice: Subject to any disclaimer, the term of this patent is extended or adjusted under 35 U.S.C. 154(b) by 617 days.

This patent is subject to a terminal disclaimer.

(21) Appl. No.: 14/514,848

(22) Filed: Oct. 15, 2014

(65) Prior Publication Data

US 2015/0108244 A1 Apr. 23, 2015

Related U.S. Application Data

(60) Provisional application No. 61/892,699, filed on Oct. 18, 2013.

(51) Int. Cl.
*B05B 12/00* (2018.01)
*A47L 11/34* (2006.01)
(Continued)

(52) U.S. Cl.
CPC ..... *B05B 12/004* (2013.01); *A47L 11/34* (2013.01); *A47L 11/4002* (2013.01);
(Continued)

(58) Field of Classification Search
CPC ... B05B 12/004; B05B 7/1693; B05B 7/2464; B05B 7/2472; B05B 7/262; B05B 12/008; B05B 12/081; B05B 1/14; B05B 7/2481; B05B 12/006; B05B 12/085; B05B 12/08; A47L 11/34; A47L 11/4002;
(Continued)

(56) References Cited

U.S. PATENT DOCUMENTS 4,199,838 A 4/1980 Simonsson
4,530,463 A * 7/1985 Hiniker ..... A01M 7/0089 239/155

(Continued)

FOREIGN PATENT DOCUMENTS

EP 2636353 A2 11/2013

OTHER PUBLICATIONS

Rhodri Evans, Search Report Under Section 17(5), 4 pages, dated Oct. 29, 2014, Intellectual Propery Office, South Wales.

*Primary Examiner* — Viet Le
*Assistant Examiner* — Christopher R Dandridge
(74) *Attorney, Agent, or Firm* — McGarry Bair PC

(57) ABSTRACT

An apparatus for cleaning a surface includes a liquid delivery system for storing cleaning liquid and delivering the cleaning liquid to the surface to be cleaned, and an indicator system that is operably coupled with the liquid delivery system to indicate an operational status to the user operating the apparatus. The indicator system can include a light emitter that illuminates when an operational status is detected. The light emitter can illuminate the container storing cleaning liquid.

13 Claims, 4 Drawing Sheets

(51) Int. Cl.

| | |
|---|---|
| ***B05B 7/24*** | (2006.01) |
| ***B05B 7/26*** | (2006.01) |
| ***B05B 12/08*** | (2006.01) |
| ***A47L 11/40*** | (2006.01) |
| ***B05B 7/16*** | (2006.01) |
| *B05B 1/14* | (2006.01) |

(52) U.S. Cl.
CPC ..... *A47L 11/4088* (2013.01); *B05B 7/1693* (2013.01); *B05B 7/2464* (2013.01); *B05B 7/2472* (2013.01); *B05B 7/262* (2013.01); *B05B 12/008* (2013.01); *B05B 12/081* (2013.01); *B05B 1/14* (2013.01); *B05B 7/2481* (2013.01)

(58) Field of Classification Search
CPC ..... A47L 11/4088; G01F 23/14; G01F 23/16; G01F 23/168
USPC ..... 239/71; 73/53.01; 221/4–8; 222/23–51
See application file for complete search history.

(56) References Cited

U.S. PATENT DOCUMENTS 4,901,922 A * 2/1990 Kessener ..... B05B 17/085 239/12
5,098,657 A * 3/1992 Blackford ..... G01N 15/065 239/74
5,927,603 A * 7/1999 McNabb ..... A01G 25/092 239/63
6,192,548 B1 2/2001 Huffman
6,848,625 B2 * 2/2005 Takekuma ..... H01L 21/67253 239/1
6,992,590 B1 * 1/2006 Tietsworth ..... B67D 1/0032 340/539.22
7,303,613 B2 12/2007 Rosenzweig
7,784,148 B2 8/2010 Lenkiwicz et al.
8,769,763 B2 * 7/2014 Kloeppel ..... A47L 11/03 15/320
9,039,844 B2 * 5/2015 Pears ..... A47L 13/225 134/58 R
2005/0125935 A1 * 6/2005 Leonatti ..... A47L 11/03 15/320
2006/0085095 A1 * 4/2006 Reindle ..... A47L 9/2821 700/258
2007/0016328 A1 * 1/2007 Ziegler ..... A47L 5/14 700/245
2007/0284457 A1 * 12/2007 Shank ..... B05B 9/002 239/135
2015/0375247 A1 * 12/2015 Funseth ..... B05B 12/04 239/68

* cited by examiner

APPARATUS FOR CLEANING A SURFACE

BACKGROUND

This application claims the benefit of U.S. Provisional Application No. 61/892,699, filed Oct. 18, 2013, which is incorporated herein by reference in its entirety.

BACKGROUND

Several different types of apparatus are known for cleaning a surface. One category of floor cleaning apparatus includes extraction cleaners for deep cleaning carpets and other fabric surfaces, such as upholstery. Most carpet extractors comprise a liquid delivery system and a liquid recovery system. The liquid delivery system typically includes one or more liquid supply tanks for storing a supply of cleaning liquid, a liquid distributor for applying the cleaning liquid to the surface to be cleaned, and a liquid supply conduit for delivering the cleaning liquid from the liquid supply tank to the liquid distributor. The liquid recovery system usually comprises a recovery tank, a nozzle adjacent the surface to be cleaned and in fluid communication with the recovery tank through a working air conduit, and a source of suction in fluid communication with the working air conduit to draw the cleaning liquid from the surface to be cleaned and through the nozzle and the working air conduit to the recovery tank.

Extraction cleaners for typical household use can be configured as an upright unit having a base for movement across a surface to be cleaned and an upright body pivotally mounted to a rearward portion of the base for directing the base across the surface to be cleaned, a canister unit having a cleaning implement connected to a wheeled base by a suction hose, or a portable extractor adapted to be hand carried by a user for cleaning relatively small areas.

BRIEF SUMMARY

According to one aspect of the invention, an apparatus for cleaning a surface includes a liquid delivery system for storing and delivering cleaning liquid to the surface to be cleaned. The liquid delivery system includes a supply container for storing the cleaning liquid and a liquid distributor for delivering liquid to the surface to be cleaned. A sensor is operably coupled with the liquid delivery system to detect an operational status of the liquid delivery system. A first indicator light is operably coupled with the sensor for indicating a first operational status to a user operating the apparatus and a second indicator light is operably coupled with the sensor indicates a second operational status to a user operating the apparatus.

According to another aspect of the invention, an apparatus for cleaning a surface includes a liquid delivery system for storing and delivering cleaning liquid to the surface to be cleaned. The liquid delivery system includes a supply container for storing the cleaning liquid having at least one light-transmissive portion and a liquid distributor for delivering liquid to the surface to be cleaned. A sensor is operably coupled with the liquid delivery system to detect liquid pressure within the liquid delivery system. First and second indicators comprising light emitting devices are positioned adjacent the supply container and are operably coupled with the sensor for indicating liquid pressure below or above a predetermined threshold value to a user operating the apparatus.

BRIEF DESCRIPTION OF THE DRAWINGS

The invention will now be described with respect to the drawings in which.

DESCRIPTION OF EMBODIMENTS OF THE INVENTION

The invention relates to an apparatus for cleaning a surface, such as an extraction cleaner that delivers cleaning liquid to a surface to be cleaned and extracts spent cleaning liquid and debris (which may include dirt, dust, stains, soil, hair, and other debris) from the surface. In one of its aspects, the invention relates to detecting and indicating a liquid delivery fault of the apparatus.

Figure 1:
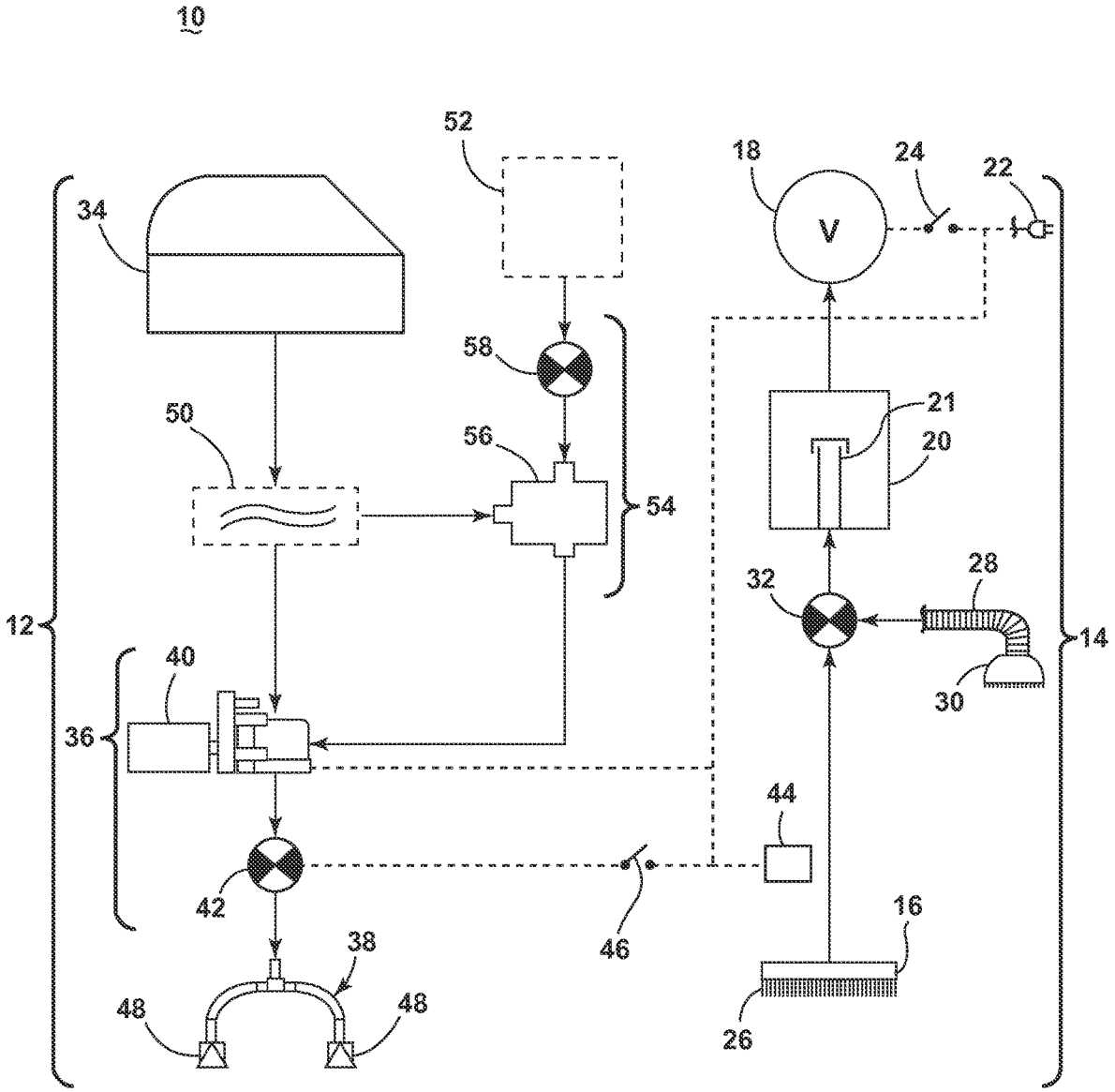
FIG. 1 is a schematic view of an apparatus for cleaning a surface illustrated as an extraction cleaner.

FIG. 1 is a schematic view of various functional systems of an extraction cleaning apparatus in the form of an extraction cleaner 10. The functional systems of the extraction cleaner 10 can be arranged into any desired configuration, such as an upright extraction device having a base and an upright body for directing the base across the surface to be cleaned, a canister device having a cleaning implement connected to a wheeled base by a suction hose, a portable extractor adapted to be hand carried by a user for cleaning relatively small areas, or a commercial extractor.

The extraction cleaner 10 can include a liquid delivery system 12 for storing cleaning liquid and delivering the cleaning liquid to the surface to be cleaned and a recovery system 14 for removing the spent cleaning liquid and debris from the surface to be cleaned and storing the spent cleaning liquid and debris.

The recovery system 14 can include a suction nozzle 16, a suction source 18 in fluid communication with the suction nozzle 16 for generating a working air stream, and a recovery container 20 for separating and collecting liquid and debris from the working airstream for later disposal. A separator 21 can be formed in a portion of the recovery container 20 for separating liquid and entrained debris from the working airflow.

The suction source 18, such as a motor/fan assembly, is provided in fluid communication with the recovery container 20. The suction source 18 can be electrically coupled to a power source 22, such as a battery or by a power cord plugged into a household electrical outlet. A suction power switch 24 between the suction source 18 and the power source 22 can be selectively closed by the user, thereby activating the suction source 18.

The suction nozzle 16 can be provided on a base or cleaning head adapted to move over the surface to be cleaned. An agitator 26 can be provided adjacent to the suction nozzle 16 for agitating the surface to be cleaned so that the debris is more easily ingested into the suction nozzle 16. Some examples of agitators include, but are not limited to, a horizontally-rotating brushroll, dual horizontally-rotating brushrolls, one or more vertically-rotating brushrolls, or a stationary brush.

The extraction cleaner 10 can also be provided with above-the-floor cleaning features. A vacuum hose 28 can be selectively fluidly coupled to the suction source 18 for above-the-floor cleaning using an above-the floor cleaning tool 30 with its own suction inlet. A diverter assembly 32 can selectively switch between on-the-floor and above-the floor cleaning by diverting fluid communication between either the suction nozzle 16 or the vacuum hose 28 with the suction source 18.

The liquid delivery system 12 can include at least one liquid container 34 for storing a supply of liquid. The liquid can comprise one or more of any suitable cleaning liquids, including, but not limited to, water, compositions, concentrated detergent, diluted detergent, etc., and mixtures thereof. For example, the liquid can comprise a mixture of water and concentrated detergent.

The liquid delivery system 12 can further comprise a flow control system 36 for controlling the flow of liquid from the container 34 to a liquid distributor 38. In one configuration, the flow control system 36 can comprise a pump 40 which pressurizes the system 12 and a flow control valve 42 which controls the delivery of liquid to the distributor 38. An actuator 44 can be provided to actuate the flow control system 36 and dispense liquid to the distributor 38. The actuator 44 can be operably coupled to the valve 42 such that pressing the actuator 44 will open the valve 42. The valve 42 can be electrically actuated, such as by providing an electrical switch 46 between the valve 42 and the power source 22 that is selectively closed when the actuator 44 is pressed, thereby powering the valve 42 to move to an open position. In one example, the valve 42 can be a solenoid valve. The pump 40 can also be coupled with the power source 22.

The liquid distributor 38 can include at least one distributor outlet 48 for delivering liquid to the surface to be cleaned. The at least one distributor outlet 48 can be positioned to deliver liquid directly to the surface to be cleaned, or indirectly by delivering liquid onto the agitator 26. The at least one distributor outlet 48 can comprise any structure, such as a nozzle or spray tip; multiple outlets 48 can also be provided. As illustrated in FIG. 1, the distributor 38 can comprise two spray tips 48 which distribute cleaning liquid to the surface to be cleaned. For above-the-floor cleaning, the cleaning tool 30 can include an auxiliary distributor (not shown) coupled with the liquid delivery system 12.

Optionally, a heater 50 can be provided for heating the cleaning liquid prior to delivering the cleaning liquid to the surface to be cleaned. In the example illustrated in FIG. 1, an in-line heater 50 can be located downstream of the container 34 and upstream of mixing pump 40. Other types of heaters 50 can also be used. In yet another example, the cleaning liquid can be heated using exhaust air from a motor-cooling pathway for the suction source 18.

As another option, the liquid delivery system can be provided with an additional container 52 for storing a cleaning liquid. For example the first container 34 can store water and the second container 52 can store a cleaning agent such as detergent. The containers 34, 52 can, for example, be defined by a supply tank and/or a collapsible bladder. In one configuration, the first container 34 can be a bladder that is provided within the recovery container 20. Alternatively, a single container can define multiple chambers for different liquids.

In the case where multiple containers 34, 52 are provided, the flow control system 36 can further be provided with a mixing system 54 for controlling the composition of the cleaning liquid that is delivered to the surface. The composition of the cleaning liquid can be determined by the ratio of cleaning liquids mixed together by the mixing system. As shown herein, the mixing system 54 includes a mixing manifold 56 that selectively receives liquid from one or both of the containers 34, 52. A mixing valve 58 is fluidly coupled with an outlet of the second container 52, whereby when mixing valve 58 is open, the second cleaning liquid will flow to the mixing manifold 56. By controlling the orifice of the mixing valve 58 or the time that the mixing valve 58 is open, the composition of the cleaning liquid that is delivered to the surface can be selected.

In yet another configuration of the liquid delivery system 12, the pump 40 can be eliminated and the flow control system 38 can comprise a gravity-feed system having a valve fluidly coupled with an outlet of the container(s) 34, 52, whereby when valve is open, liquid will flow under the force of gravity to the distributor 38. The valve can be mechanically actuated or electrically actuated, as described above.

The extraction cleaner 10 shown in FIG. 1 can be used to effectively remove debris and liquid from the surface to be cleaned in accordance with the following method. The sequence of steps discussed is for illustrative purposes only and is not meant to limit the method in any way as it is understood that the steps may proceed in a different logical order, additional or intervening steps may be included, or described steps may be divided into multiple steps, without detracting from the invention.

In operation, the extraction cleaner 10 is prepared for use by coupling the extraction cleaner 10 to the power source 22, and by filling the first container 34, and optionally the second container 52, with cleaning liquid. Cleaning liquid is selectively delivered to the surface to be cleaned via the liquid delivery system 12 by user-activation of the actuator 44, while the extraction cleaner 10 is moved back and forth over the surface. The agitator 26 can simultaneously agitate the cleaning liquid into the surface to be cleaned. During operation of the recovery system 14, the extraction cleaner 10 draws in liquid and debris-laden working air through the suction nozzle 16 or cleaning tool 30, depending on the position of the diverter assembly 32, and into the downstream recovery container 20 where the liquid debris is substantially separated from the working air. The air flow then passes through the suction source 20 prior to being exhausted from the extraction cleaner 10. The recovery container 20 can be periodically emptied of collected liquid and debris.

Figure 2:
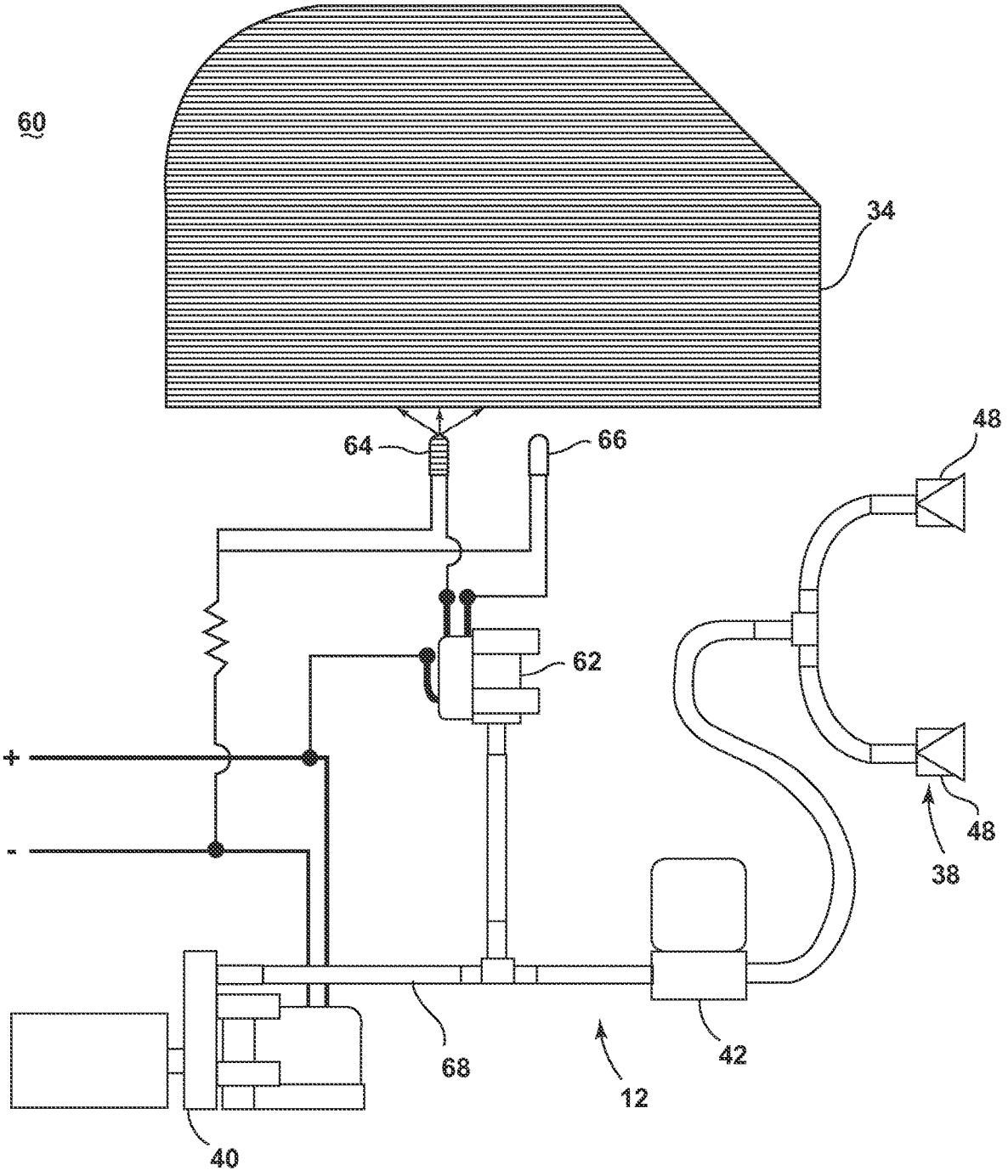
FIG. 2 is a schematic view of an indicator system of an extraction cleaner according to a first embodiment of the invention, showing a ready condition of the liquid delivery system.

FIG. 2 is a schematic view of an indicator system 60 of the extraction cleaner 10 according to a first embodiment of the invention. The indicator system 60 is operably coupled with the liquid delivery system 12 of FIG. 1 to indicate the operational status of the liquid delivery system to the user of the extraction cleaner 10. The operational status can include whether the liquid delivery system 12 is ready for operation, or not. For example, the indicator system 60 can indicate a first detected operational status that is indicative of a liquid delivery fault of the liquid delivery system 12, i.e. that the liquid delivery system 12 is non-operational. In another example, the indicator system 60 can indicate a second detected operational status indicative of the delivery system 12 being operative and ready for use.

The indicator system 60 includes a liquid pressure sensor 62 in the liquid delivery path that is electrically connected to a first light emitter 64 that is configured to illuminate when the liquid delivery system 12 is operative and ready for liquid dispensing, and a second light emitter 66 that is configured to illuminate when a liquid delivery fault is detected. Examples of liquid delivery faults include: an empty container 34 or 52; a pump failure, such as the failure of the pump 40 to prime; and clogs, restrictions or leaks in the liquid delivery path upstream from the pressure sensor 62. For example, clogs or restrictions can be caused by foreign particles in the supply of liquid in the container 34 or 52, the build-up of hard water deposits in the liquid delivery path, kinks in a conduit or tube defining a portion of the liquid delivery path, oxidation of metallic components such as the heater 50, or faulty valves. Leaks can be caused by holes, cracks, faulty seals or loose connections between components in the liquid delivery path, for example.

The indicator system 60 will be discussed herein with respect to the configuration of the liquid delivery system 12 discussed herein having a single container 34 and the pump 44, although it is understood that the indicator system 60 is also applicable to the systems 12 having multiple containers 34, 52 and/or a gravity-feed system.

The liquid delivery fault can be detected by determining whether liquid pressure within the liquid delivery system 12 is below a predetermined threshold value. The pressure sensor 62 can be provided in a liquid conduit 68 coupling an outlet of the pump 40 to an inlet of the flow control valve 42. Other locations for the pressure sensor 62 within the liquid delivery system 12 are also possible, such as within the container 34, upstream of the pump 40, or downstream of the flow control valve 42.

When the container 34 contains sufficient liquid and the pump 40 is primed and operational, the pressure in the conduit 68 between the pump 40 and valve 42 is above the predetermined threshold value and thus actuates the pressure sensor 62. The pressure sensor 62, in turn, can control the illumination of the first light emitter 64 to signal that the liquid delivery system 12 is in a "ready" or "operational" condition.

Conversely, when the container 34 is empty or when the pump 40 is not primed, the pressure in the conduit 68 between the pump 40 and valve 42 drops to a level that deactivates the pressure sensor 62. Upon deactivation, the pressure sensor 62 can either turn off the first light emitter 64 and, or alternatively, illuminate the second light emitter 66. Illumination of the second light emitter 66 can signal that the liquid delivery system 12 is in a "fault" or "non-operational" condition.

In one embodiment, different color LEDs may be used as the light emitters 64, 66. For example, a blue or green light emitter 64 can indicate the liquid delivery system 12 is ready and a red light emitter 66 can indicate that the liquid delivery system 12 needs user attention due to low/no flow of cleaning liquid.

Figure 3:
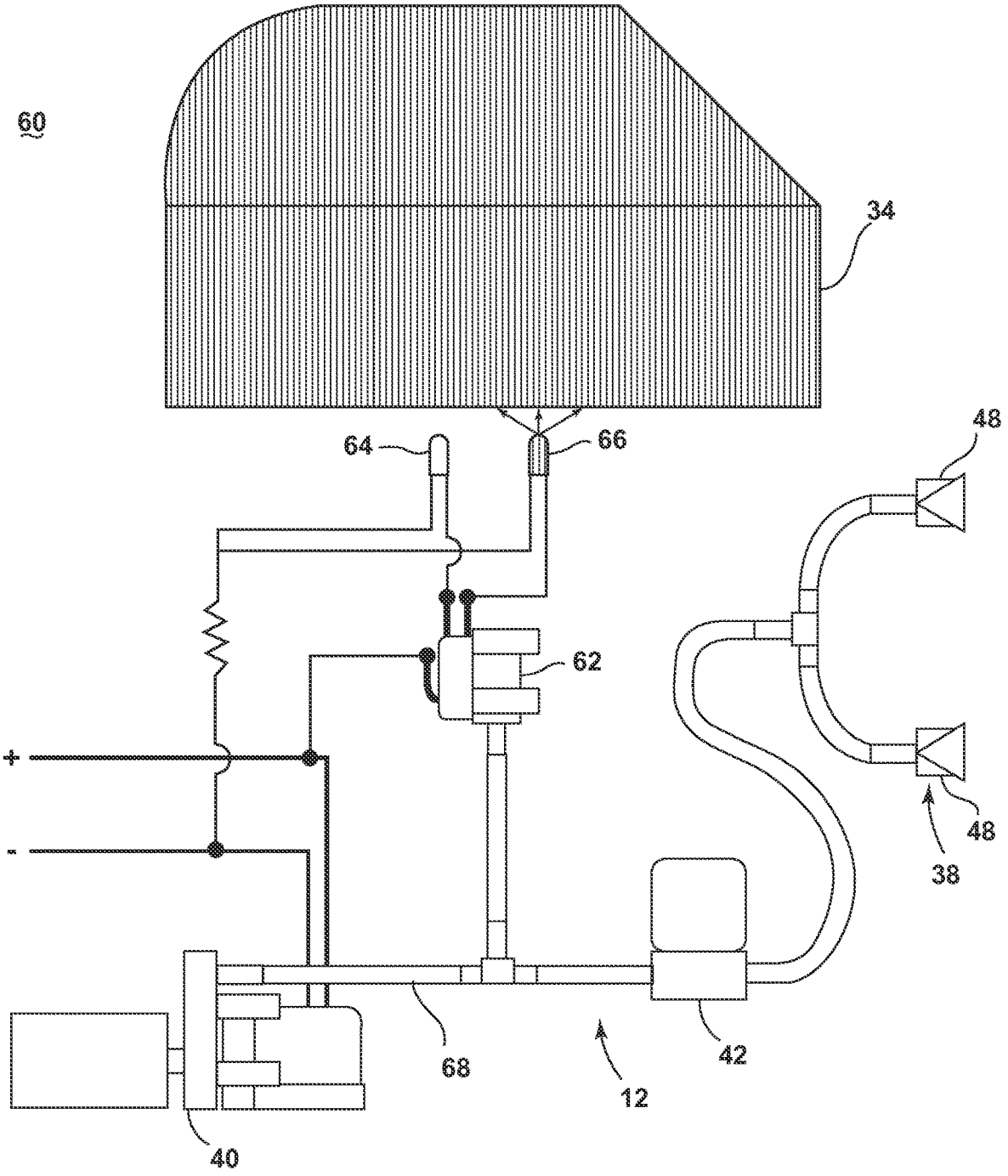
FIG. 3 is a schematic view of the indicator system from FIG. 2, showing a fault condition of the liquid delivery system.

Referring to FIGS. 2-3, the container 34 can be light-transmissive in that it can allow at least some light to pass through its walls. Light-transmissive materials include those that are at least partially transparent or translucent. The light emitters 64, 66 can be positioned below the light-transmissive container 34 to illuminate the space within the container 34 and so that the light is visible through the container walls. In this example, the first light emitter 64 is an LED which emits blue light and the second light emitter 66 is an LED which emits red light, as indicated by the horizontal and vertical line shading used in FIG. 2-3, which are the ANSI symbols for the colors blue and red, respectively. The container 34 can be made entirely of a light-transmissive material, or can be provided with one or more sections of light-transmissive material.

FIG. 2 shows the "ready" or "operational" condition of the liquid delivery system 12, in which sufficient cleaning liquid is available in the container 34 and the pump 40 is primed and pressurized. In this case, the blue light emitter 64 is activated, and emits blue light through the container. The blue light is visible to the user through the container 34, and the container 34 may appear to "glow" blue by the illumination of the container walls and any liquid within the container 34.

FIG. 3 shows the "fault" or "non-operational" condition of the liquid delivery system 12, in which insufficient cleaning liquid is available in the container 34 and/or the pump 40 is not primed. In this case, the red light emitter 66 is activated, and emits red light through the container 34. The red light is visible to the user through the container 34, and the container 34 may appear to "glow" red by the illumination of the container walls and any liquid within the container 34.

Figure 4:
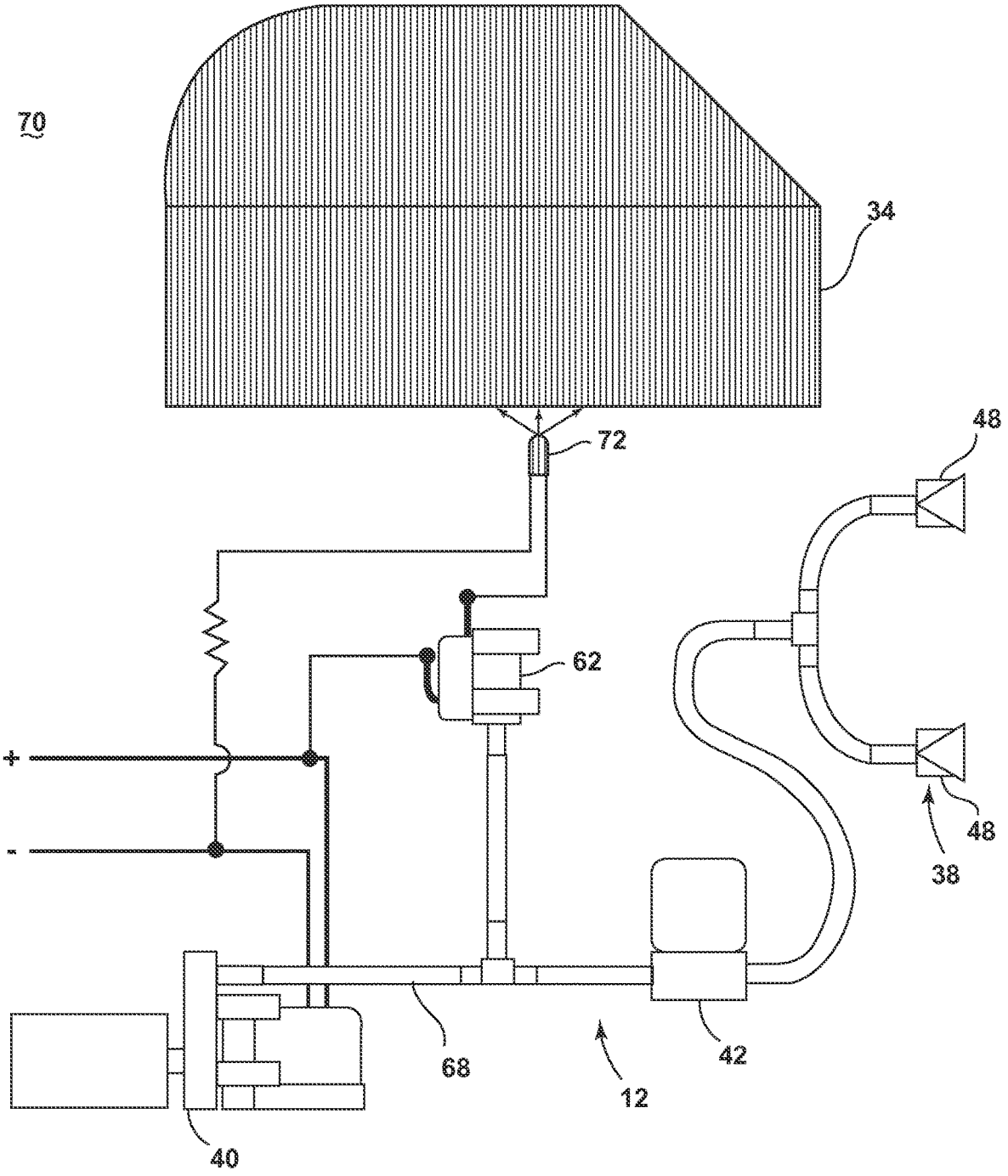
FIG. 4 is a schematic view of an indicator system of an extraction cleaner according to a second embodiment of the invention, showing a fault condition of the liquid delivery system.

FIG. 4 is a schematic view of an indicator system 70 of the extraction cleaner 10 according to a second embodiment of the invention. The indicator system 70 is substantially similar to the indicator system 60 of the first embodiment, and like elements are referred with the same reference numerals. The indicator system 70 of the second embodiment differs in that the liquid pressure sensor 62 is connected to a single light emitter 72 that is configured to illuminate when a liquid delivery fault is detected.

When the container 34 contains sufficient liquid and the pump 40 is primed and operational, the pressure in the conduit 68 between the pump 40 and valve 42 is above the predetermined threshold value, the light emitter 72 is not illuminated. However, when the container 34 is empty or when the pump 40 is not primed the pressure in the conduit 68 between the pump 40 and valve 42 drops to a level that deactivates the pressure sensor 62. Upon deactivation, the pressure sensor 62 can illuminate the light emitter 72. Illumination of the light emitter 72 can signal that the liquid delivery system 12 is in a "fault" or "non-operational" condition.

Like the first embodiment, the light emitter 72 can be positioned below the light-transmissive container 34 to illuminate the space within the container 34 and so that the light is visible through the container walls. In this example, the light emitter 72 is an LED which emits red light, as indicated by the red line shading used in FIG. 4.

FIG. 4 shows the "fault" or "non-operational" condition of the liquid delivery system 12, in which insufficient cleaning liquid is available in the container 34 and/or the pump 40 is not primed. In this case, the light emitter 72 is activated, and emits red light through the container 34. The red light is visible to the user through the container 34, and the container 34 may appear to "glow" red by the illumination of the container walls and any liquid within the container 34.

The method and apparatus disclosed herein provides a floor cleaning apparatus with an indication system for notifying the user when a liquid delivery fault occurs. Although not explicitly shown herein, the indicator system 60 disclosed herein can be applied to other types of cleaning apparatuses that incorporate liquid delivery systems. For example, the indicator system 60 can be applied to steam cleaners, steam mops, floor scrubbers, spray mops and autonomous floor cleaners.

One advantage that may be realized in the practice of some embodiments of the described indicator system is that the indicator light gives the user an obvious and easy-to-interpret indication of when the cleaning liquid supply is low or depleted, or when the pump does not prime. Previous extraction cleaners have used spinning flow indicators to notify the user when the water container is empty, but these can be difficult to see. Another advantage that may be realized in the practice of some embodiments of the described indicator system is that the indicator lights are fluidly isolated and separate from the liquid flow path, and thus do not require additional fluid connections, which can create the opportunity for leakage that is problematic with spinning flow indicators. The features, alone or in combination, create a superior indication system for extraction cleaners.

The disclosed embodiments are representative of preferred forms of the invention and are intended to be illustrative rather than definitive of the invention. To the extent not already described, the different features and structures of the various embodiments may be used in combination with each other as desired. That one feature may not be illustrated in all of the embodiments is not meant to be construed that it may not be, but is done for brevity of description. Thus, the various features of the different embodiments may be mixed and matched as desired to form new embodiments, whether or not the new embodiments are expressly described. Reasonable variation and modification are possible within the forgoing disclosure and drawings without departing from the scope of the invention which is defined by the appended claims.

What is claimed is:

1. An apparatus for cleaning a surface, comprising:

a liquid delivery system for storing and delivering a cleaning liquid to the surface to be cleaned, the liquid delivery system comprising:

a supply container for storing the cleaning liquid; and a liquid distributor for delivering the cleaning liquid to the surface to be cleaned;

a sensor operably coupled with the liquid delivery system to detect a liquid pressure within the liquid delivery system;

a first light emitter operably coupled with the sensor, the first light emitter configured to indicate the liquid pressure below a predetermined threshold value to a user operating the apparatus; and a second light emitter operably coupled with the sensor, the second light emitter configured to indicate the liquid pressure above a predetermined threshold value to a user operating the apparatus;

wherein the first light emitter and the second light emitter indicate the detected liquid pressure via illumination transmitted through the supply container;

wherein the first light emitter and the second light emitter are positioned proximate to the supply container; and wherein at least a portion of the supply container is light-transmissive.

2. An apparatus for cleaning a surface, comprising:

a liquid delivery system for storing and delivering a cleaning liquid to the surface to be cleaned, the liquid delivery system comprising:

a supply container for storing the cleaning liquid; and a liquid distributor for delivering the cleaning liquid to the surface to be cleaned;

a sensor operably coupled with the liquid delivery system to detect an operational status of the liquid delivery system;

a first indicator light operably coupled with the sensor for indicating a first detected operational status to a user operating the apparatus, and positioned to selectively illuminate the supply container and where the first detected operational status is an operational condition of the liquid delivery system; and a second indicator light operably coupled with the sensor for indicating a second detected operational status to a user operating the apparatus, and positioned to selectively illuminate the supply container and where the second detected operational status is a fault condition of the liquid delivery system;

wherein the supply container is mounted over the first indicator light and the second indicator light, and, when one of the first indicator light or the second indicator light illuminates the supply container, the illumination from the first indicator light or the second indicator light is visible to the user only indirectly through the supply container.

3. The apparatus for cleaning a surface of claim 2 wherein the liquid delivery system further comprises a liquid delivery path and the sensor is located in the liquid delivery path.

4. The apparatus for cleaning a surface of claim 3, further comprising a pump for pressurizing the liquid delivery system.

5. The apparatus for cleaning a surface of claim 4 wherein the sensor is provided within the liquid delivery path fluidly downstream of the pump.

6. The apparatus for cleaning a surface of claim 1 wherein the sensor is electrically connected to the first light emitter and the second light emitter.

7. The apparatus for cleaning a surface of claim 2 wherein the first and second indicator lights are different colors.

8. The apparatus for cleaning a surface of claim 2 wherein the first detected operational status is indicative of a liquid delivery fault and the second detected operational status is indicative of the liquid delivery system being ready for liquid delivery.

9. The apparatus for cleaning a surface of claim 8 wherein the liquid delivery fault comprises at least one of an empty supply container, a pump failure, or a clog, restriction or leak in the liquid delivery system.

10. The apparatus for cleaning a surface of claim 3 wherein the sensor detects a liquid pressure within the liquid delivery path.

11. The apparatus for cleaning a surface of claim 2 wherein the first detected operational status comprises a liquid delivery fault.

12. The apparatus for cleaning a surface of claim 2, further comprising a pump for pressurizing the liquid delivery system.

13. The apparatus for cleaning a surface of claim 12 wherein the sensor is provided within the liquid delivery system fluidly downstream of the pump.

* * * * *